US006592091B1

(12) United States Patent
Michaels

(10) Patent No.: US 6,592,091 B1
(45) Date of Patent: Jul. 15, 2003

(54) HAIR-DRYER HOLDER

(76) Inventor: Peter Michaels, 24-1711 Kingston Road, Scarborough, Ontario (CA), M1N 1S8

( * ) Notice: Subject to any disclaimer, the term of this patent is extended or adjusted under 35 U.S.C. 154(b) by 0 days.

(21) Appl. No.: 10/170,143

(22) Filed: Jun. 5, 2002

(51) Int. Cl.[7] ..... A47F 5/00
(52) U.S. Cl. ..... 248/301; 248/314
(58) Field of Search ..... 248/314, 117.5, 248/117.6, 311.3, 300, 301; 34/97

(56) References Cited

U.S. PATENT DOCUMENTS 4,673,148 A * 6/1987 Oliver ..... 248/292.14
5,026,016 A * 6/1991 Lisowski ..... 248/314
D343,024 S * 1/1994 Blaisdell ..... D28/18

* cited by examiner

*Primary Examiner*—Ramon O. Ramirez

(57) ABSTRACT

A Hair-Dryer Holder to provide a safer, more economical, and stable receptacle with multiple hair dryer handle insertion slots permitting a variable positioning feature and upright installation to the right, left or forward wall relative to the user's stance in front of a bathroom mirror and the user's preference to insert the hair dryer so that the handle can be parallel to the wall and therefore less obstructive. The receptacle provides three handle insertion slots being 90 degrees offset from each other in series, each said slot similarly as said receptacle being variably sized and tapered to accommodate most said hair dryers. A built-in hook at the front of said receptacle to accommodate most attaching electrical cords. Having an electrical cord storage hook, the multiple hair dryer handle insertion and storage positions minimize handle obstruction or accident and once stored, said hair dryer is more safely enclosed in a rigid, non-flexible, one piece construction and thus said receptacle is not able to disassemble itself.

2 Claims, 7 Drawing Sheets

HAIR-DRYER HOLDER

BACKGROUND OF THE INVENTION

Most people utilize a hand held portable hair dryer to dry their hair. Accessing and storage of said hair dryers is time consuming, inconvenient and a safety concern. Improper storage can result in a safety hazard especially if the attached electrical cord of said hair dryer is left laying connected electrically on a surface within unsafe proximity to the bathroom sink and water. Even people who disconnect and wrap the electrical cord around said hair dryer while storing are repeatedly fatiguing and or stretching the electrical cord wiring and insulation thus increasing the safety hazard over time. The Hair-Dryer Holder is a universal multi-positional storage receptacle for the safer and easier accessibility of most common hand held portable hair dryers and is designed to provide a rigid, non flexible and stable receptacle in a one piece construction which permits upright mounting variability onto the safest wall location especially since it provides multiple hair dryer handle insertion slots and in the initial design presented, three, each ninety degrees offset from each other in series and being variably sized and tapered as is the entire said receptacle to accommodate most said hair dryers and to enable the user variable and thus safest and most convenient slot selection to afford the least obstructive hair dryer handle storage position such as inserting said hair dryer to enable handle to be parallel to the wall and not protruding outward and thus, since there are multiple insertion slots, this allows for variable said receptacle location on user's choice of wall for installation. In essence, the design presented having three slots permits the user to mount said receptacle to the wall on his or her right, on his or her left and on the wall forward of their stance usually facing the vanity and or bathroom mirror. Further, The Hair-Dryer Holder also possesses a built-in hook of sufficient size and strength to accommodate the attached electrical cord thus promoting safer storage of said hair dryer and reducing accidental hazard from counter space clutter. The Hair-Dryer Holder once properly and safely installed, enables the user to quickly find, access and safely store most said hair dryers and their attached electrical cords. Prior art does not provide this greater degree of safety, the variability of wall installation locations resulting from the multiple insertion slots available within said receptacle and thus multiple storage position choice to minimize obstruction and thus minimize potential unintended contact with the protruding handle. Further, prior art does not additionally provide an electrical cord storage hook to promote safety by encouraging disconnection of said hair dryers by providing a means by which to safely store said attached electrical cord as well as said hair dryer from accidental contact especially if otherwise left connected or laying unsafely on the counter. Use of The Hair-Dryer Holder additionally should eliminate the tendency of users to wrap and thus stretch and fatigue said cord and thus said receptacle reduces and or eliminates that otherwise increasing electrical hazard over time. Finally, said receptacle is novel in providing a more economical and safely stable once piece construction. This design is simple enough to be produced at costs much lower than prior art. Further, this design affords an enclosure which is more protective and incapable of accidental disassembly since it is only one piece. Prior art is not as easily or economically made or affordable as said receptacle. Further, this design promotes storage only. Also, Prior art advocates and or caters to users who wish to operate said hair dryers for hands free use utilizing their devices. This inventor deems that unwise and unsafe especially in such close proximity to sinks, tubs and water. The Hair-Dryer Holder will provide and promote safety and convenience.

BRIEF SUMMARY OF THE INVENTION

The Hair-Dryer Holder is designed to provide a safe, economical, and stable one piece, universal, multi-positional hair dryer storage receptacle which provides multiple hair dryer handle insertion slots thus providing most hair dryers a variable positioning feature and permitting upright installation to the right, left or forward wall relative to the user's choice and stance in front of a mirror and the user's preference to insert the hair dryer so that the handle can be parallel to the wall and not protruding and therefore less obstructive. The main body of said receptacle as well as the hair dryer handle insertion slots are variably sized and tapered to accommodate most hair dryers. Further, the Hair-Dryer Holder also possesses a built-in hook of sufficient size and strength at the front of said receptacle to facilitate hanging of the electrically disconnected hair dryer electrical cord thus promoting safer storage of said hair dryer and cord thus reducing accidental hazard and counter space accident from clutter.

DETAILED DESCRIPTION OF THE INVENTION

The following are detailed descriptions which make reference to the diagram figures and the aspects of the invention being the Hair-Dryer Holder which is a universal, multi-positional storage receptacle for most common portable hair dryers and their attaching electrical cords. Said aspects and or features are cited by number and your attention is directed to said aspects and or feataures by diagrams, numbers and arrows. Said invention will be referred to as said receptacle.

Figure 1:
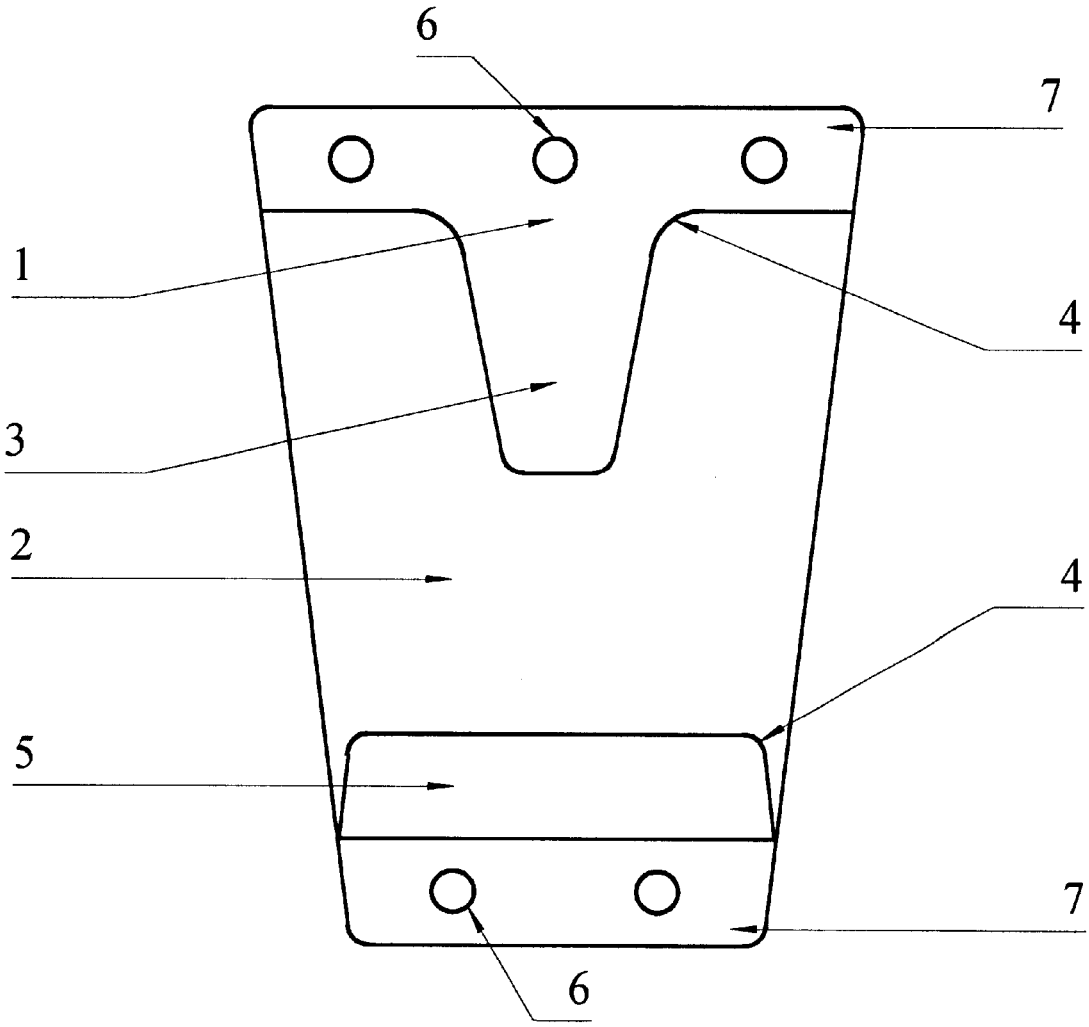
FIG. 1 shows a frontal view of the Hair-Dryer Holder which is a universal, multi-positional storage receptacle for most common hand held portable hair dryers and showing the center or front variable slot to accommodate forward installations onto facing walls such as those rear of counters where mirrors are located.

In drawing FIG. 1, there exists the flat back, noted as item 1 of said receptacle which is the mounting surface which is be affixed to and lay flat on a wall using proper strength screw fasteners and size matching screw plugs which should be installed into the wall prior into the selected wall, said screws to be installed through installation holes noted as items 6. Note that said receptacle is to be affixed to a wall with the widest part of item 1 pointing directly and as squarely as possible upward and the narrowest part of item 1 is to be pointing directly and as squarely as possible downward.

Still in FIG. 1, we note item 2 which is the enclosure and wrap-around part of said receptacle which is moulded to and one piece with item 1. While item 1 is flat, item 2 is less squared in that item 2 adjoins item 1 in an arc-like fashion and item 2 has rounded edges tapering from a larger opening at the top to a smaller opening at the bottom. Most all edges of said receptacle are rounded and smooth to prevent injury upon contact and also to increase the strength of all adjoining surfaces by arcing all changes in surface direction. Note that all items 4 noted refer to rounded or arced edges and or surfaces. Additionally, both item 1 and item 2 are in fact combined to form entire said receptacle as one piece being the result of plastic injection from molding. Isolating items 1 and 2 is done to illustrate differing features only as these two items are not separate but part of one piece.

Combined items 1 and 2 being actually one piece has a larger perimeter diameter at their upper most combined parts than their lower most points.

Figure 4:
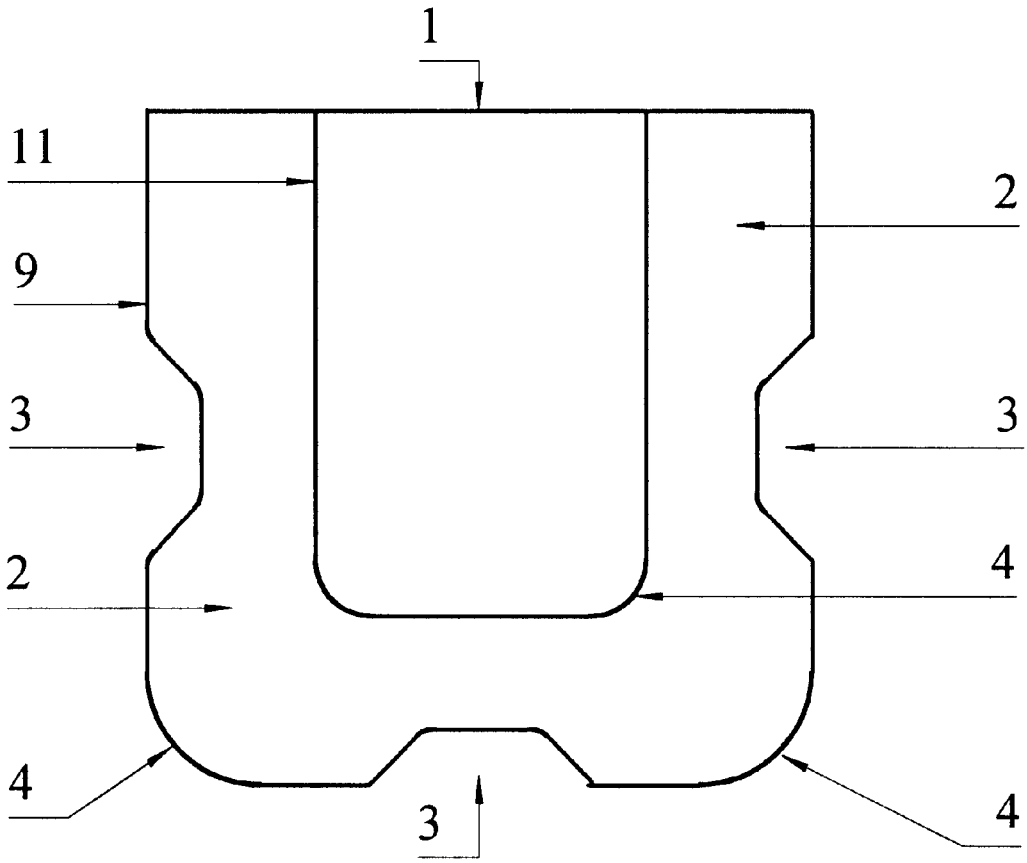
FIG. 4 shows the top or aerial view of said receptacle. Note that item 9 indicates the upper perimeter of the housing which is greater than item 11 which is the lower perimeter of the housing. The housing is tapered from a larger upper opening to accommodate the bulky portion of most hand held portable hair dryers wherein is contained the blower and the handle which emanates from said bulky portion and said handle may be inserted through multiple insertion slots at the upper perimeter of said receptacle enclosure housing. Thus the lower perimeter item 11 is reduced and tapered to accommodate and make more secure, the blower tube of said hair dryers. The lower perimeter shown as item 11 provides reduced lateral sway and thus helps keep these hair dryers in a more upright position and more stable.
Figure 5:
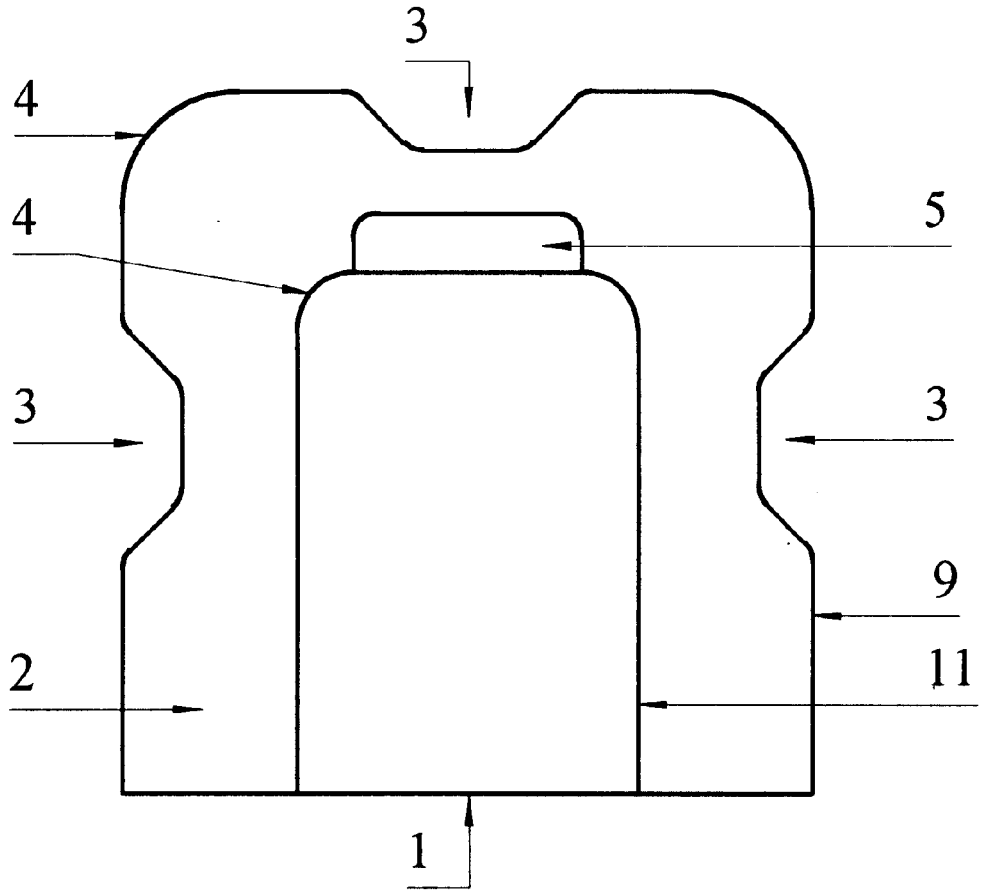
FIG. 5 shows the bottom view looking up. Again note taper description as noted in FIG. 4 description. Thus the reduced taper provides a 'tighter' fit and stability of the inserted object. Note that item 5 (the electrical cord hook) can now be seen as it protrudes from the lower end of the enclosure on the outside, but could not be seen from a perfect overhead view wherein the upper perimeter exceeds the lower perimeter.

Item 1 is larger in width at it's upper most point as indicated by item 9 in FIGS. 4 and 5. FIG. 4 shows the view from directly above and looking squarely downward revealing the larger upper perimeter of combined items 1 and 2 as indicated by item 9, the upper most edge. Note now that item 11 indicates the lower most edge and smaller perimeter of combined items 1 and 2.

In FIG. 5 we see the view from directly below and looking squarely upward. Again, item 11 which would be closest to the viewer, indicating the reduced perimeter of combined items 1 and 2. Item 9 which is farthest from said viewer, reveals a larger perimeter and the hair dryer handle insertion slots noted as items 3 emanating downward from all three sides of item 2. At the lowest most point item 1 is now seen to be smaller in width.

We now see that said receptacle from upper most to lower most points is variably sized and tapered from top to bottom. The variable sizing and taper allows for the larger and bulky blower motor and heating element portion of most hand held hair dryers to be accommodated within the upper most enlarged portion of combined items 1 and 2 of said receptacle while the hair dryer blow tube which is generally smaller, is accommodated within the lower most and taper reduced enclosure sizing of combined items 1 and 2 . This tapering to a smaller enclosure size at the lower most point also limits to and from play of the blower tube portion of most any inserted portable hair dryer thus making the resting position of said hair dryer to be more stable and secure. Therefore, said receptacle reduces or tapers from a larger internal capacity at the upper most portion within combined items 1 and 2, to a smaller internal capacity at the lower most portion within combined items 1 and 2 of said receptacle.

Item 3 shown in FIGS. 1, 2, 3, 4, and 5 represents the hair dryer handle insertion slots available. In the example as shown, there are three such said slots, each being approximately 90 degrees offset from one another from left to right when viewed from the front of said receptacle. Each said hair dryer handle insertion slot is tapered and having a larger opening at the upper perimeter of item 2 and a smaller opening below the upper perimeter of item 2. The tapering of said slots as the tapering of the entire said receptacle, allows for variable hair dryer sizes and once either hair dryer handle and or entire hair dryer is inserted, said hair dryer will come to rest with reduced slack or play in said rest position whether it be an intereference fit within the length of the taper or resting at the bottom of said handle insertion slot. The purpose is to stabilize the hair dryer in said rest position.

Figure 2:
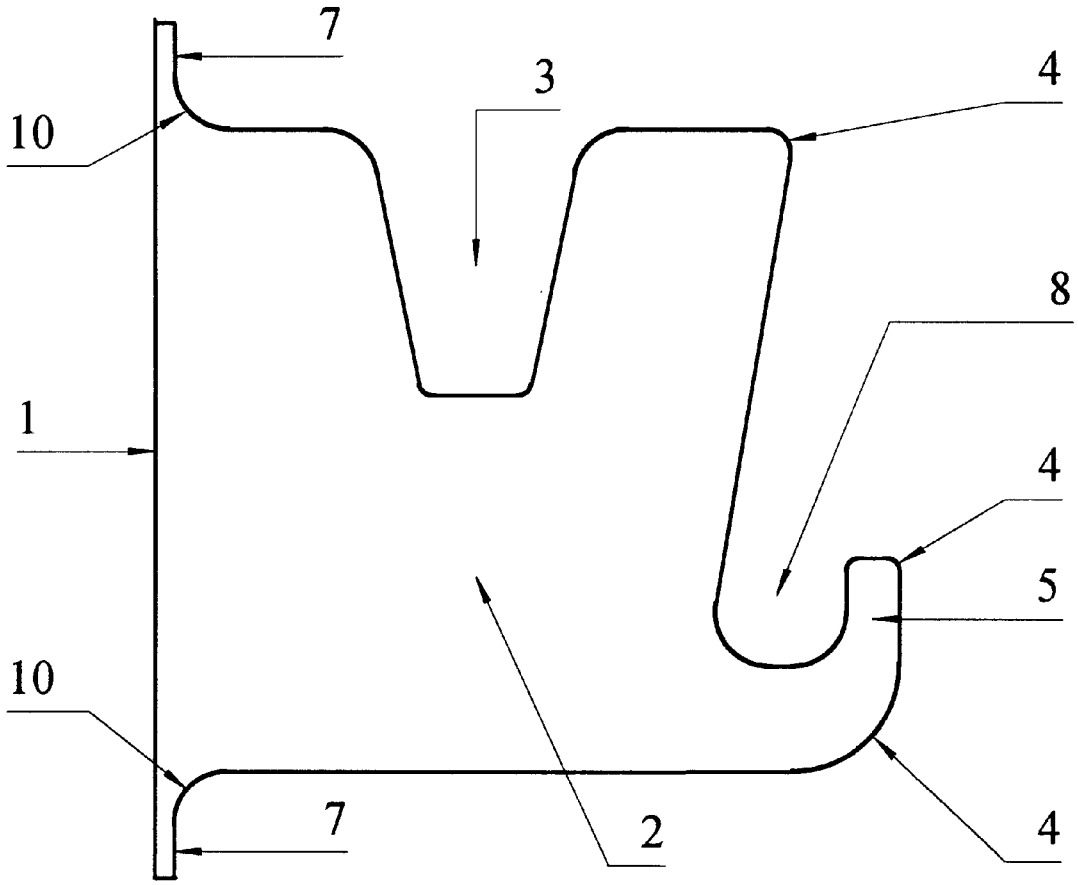
FIG. 2 shows a right view of said receptacle showing the right side variable slot which could be utilized when installed on a left wall. Note item 5 showing the hook area to accommodate electrical cord storage. Also note that all joining edges are rounded for safety.
Figure 3:
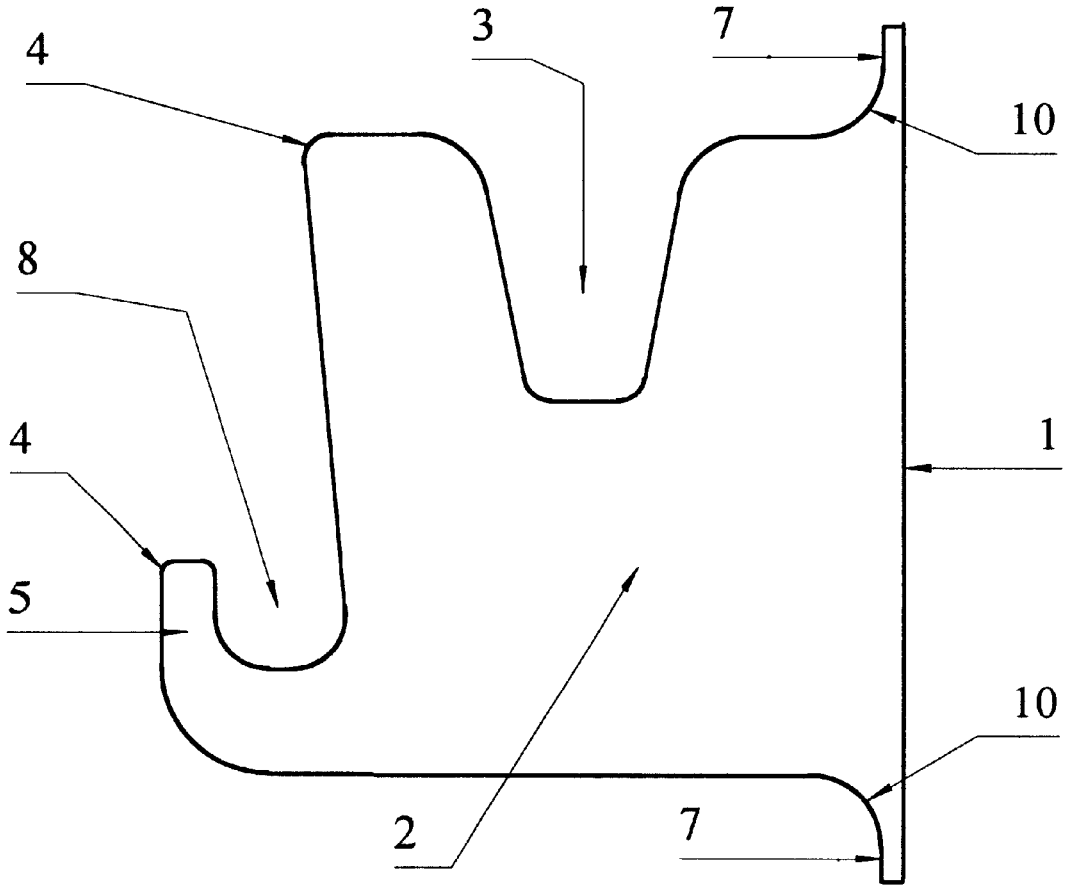
FIG. 3 shows a left view of said receptacle showing the left side variable slot which could be utilized when installed on a right wall. Again, note item 5 showing the hook area to accommodate electrical cord storage. Also note that all joining edges are rounded for safety.

In FIGS. 1, 2 and 3 we should note item 7 which is the part of item 1 which extends past the upper and lower most point of item 2. Item 7 provides a lip or extension for added strength and to facilitate easy access to the installation holes noted as item 6 and thus to allow for easy and safe installation of said receptacle. Item 10 is the arc of item 2 as it adjoins item 1 to form one piece and additionally a stronger linking to item 1 as opposed to a perpendicular linking. By this we strengthen combined items 1 and 2 and minimize the strain of item 2 as it adjoins item 1 once a said hair dryer is inserted into said receptacle. In FIGS. 1, 2, 3, and 5 we see the protruding hook area to accommodate the hanging of a hair dryer's attached electrical cord. Note how item 5 is located at the lower most frontal surface in FIG. 1 and that item 5 extends across most of the entire frontal width of item 2 that surface being most distant from and parallel to item 1 when viewed from the front and squarely ahead. Item 5 is designed to be substantial in size and strength to ensure adequate and safe support for a hair dryer's attached electrical cord. Item 8 in FIGS. 2 and 3 illustrates an example cavity or area allowance for locating loops of said cord within the hook area being item 8 within item 5.

Figure 6:
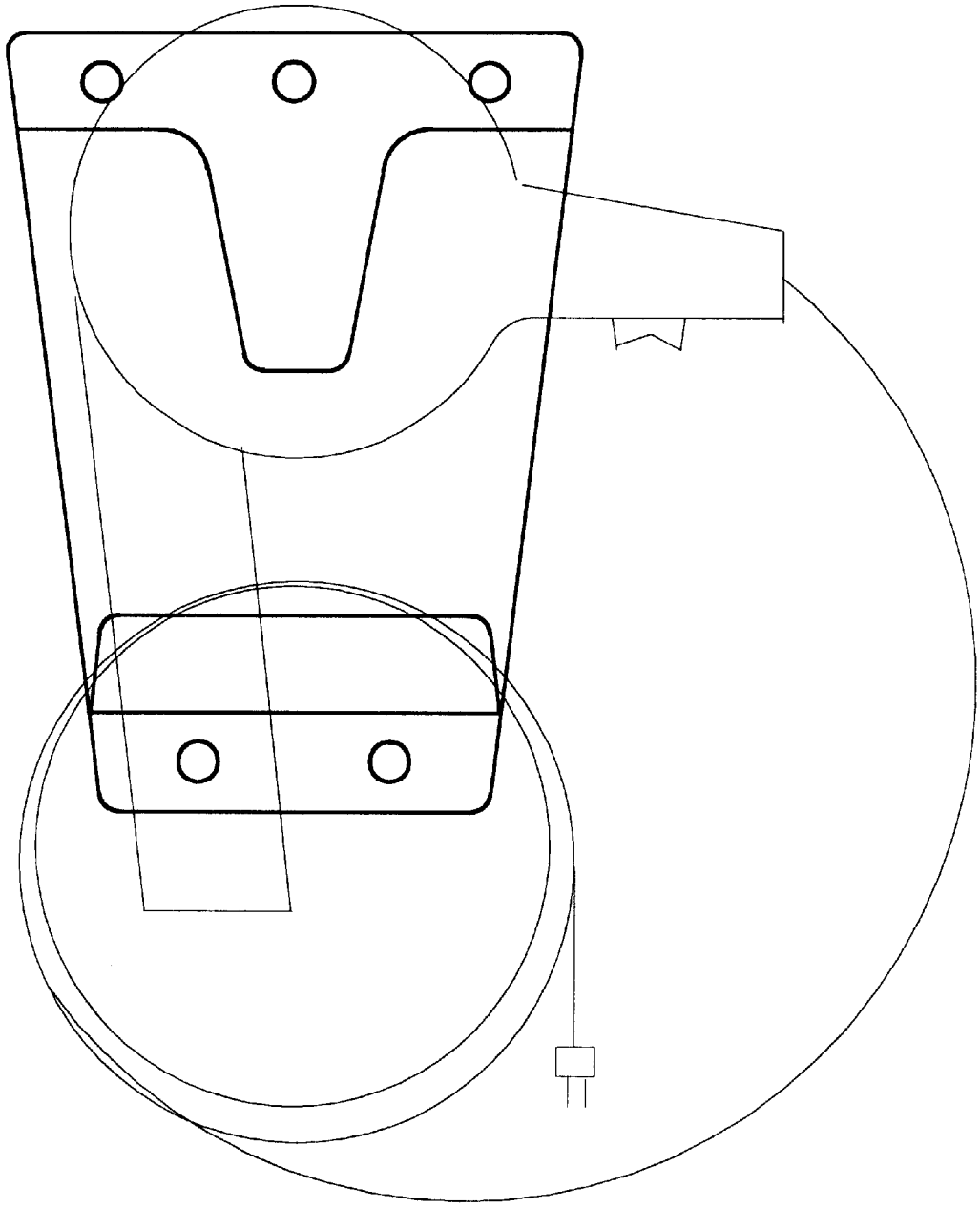
FIG. 6 shows a frontal view of said receptacle as in FIG. 1 here simulating a generic common hair dryer within said receptacle as if inserted and as if said receptacle were transparent. Note that said hair dryer and attaching electrical cord are drawn with thinner lines to help differentiate between said receptacle and simulated generic common hair dryer for purposes of illustration.
Figure 7:
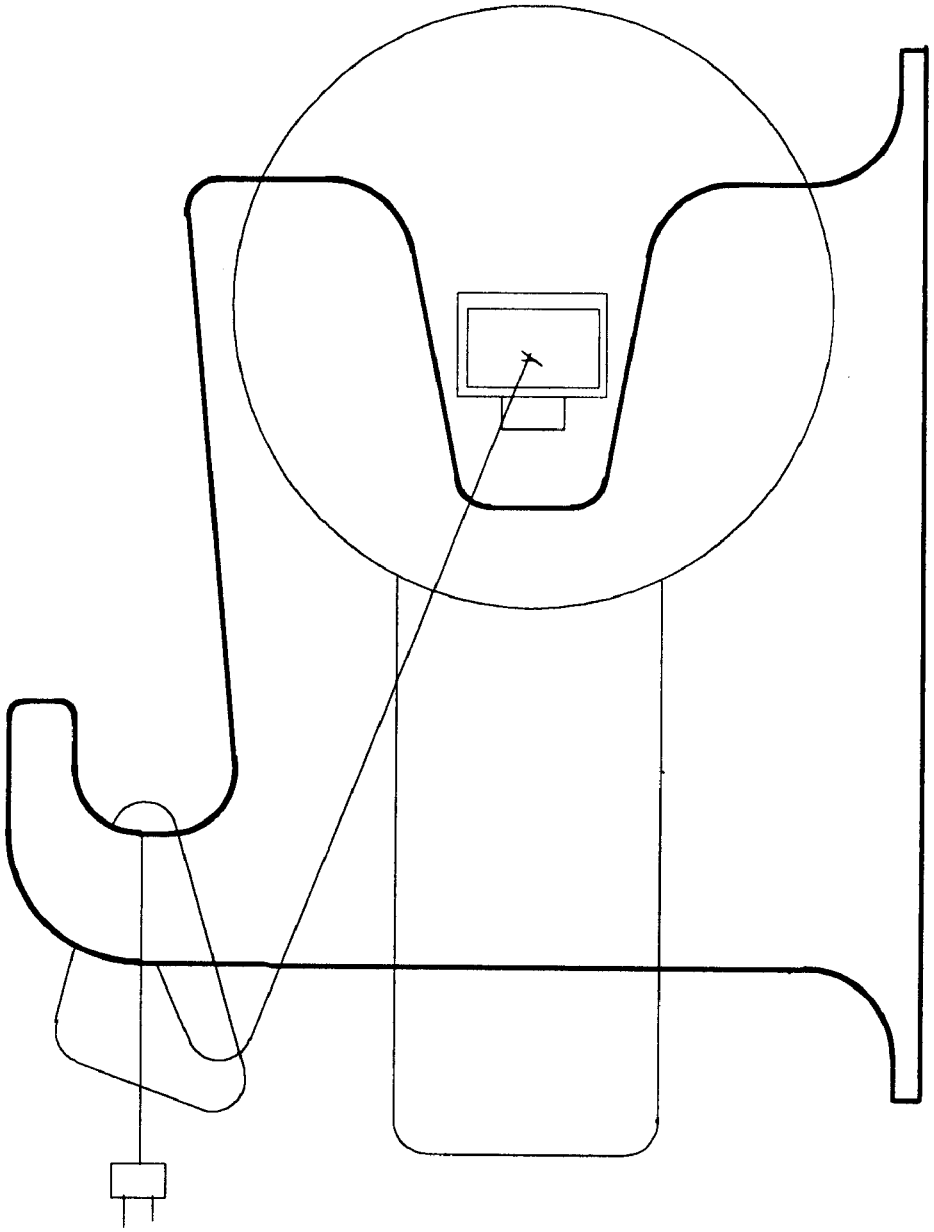
FIG. 7 shows a left view of said receptacle showing the left side variably tapered hair dryer handle insertion slot which would be utilized when installed on a right wall and note as is the purpose of FIG. 6, in FIG. 7, a generic common hair dryer within said receptacle as if inserted and as if said receptacle were transparent. Again, as in FIG. 6, Note that said hair dryer and attaching electrical cord are drawn with thinner lines to help differentiate between said receptacle and simulated generic common hair dryer for purposes of illustration.

FIGS. 6 and 7 show front and side views of said receptacle respectively having an illustrative example hair dryer inserted within said receptacle. Said illustrative hair dryer outline utilizes thinner lines so as to more readily differentiate between said receptacle and a generic and common portable hair dryer outline shown in conjunction with said receptacle.

As shown in all figures, the multiple and tapered hair dryer handle insertion slots allows a user variability in choice of positioning dependent upon user's choice of wall to install said receptacle as well as user's choice of handle position to allow user to minimize said handle's obstruction such as mounting said handle parallel to a right or left wall when facing a mirror or mounting in the centre said slot if mounting said receptacle straight ahead on the mirror wall in front of user. Said receptacle is designed to maximize utility and safe storage of said hair dryers.

The initial design is presented to provide simplicity for illustration purposes and does not limit the variability of specific design, item arrangement and or configuration. Therefore this presentation should not be restrictive in that much variability exists which is still consistent with the intent and spirit of the invention.

What I claim is:

1. A universal, multi-positional storage receptacle for the safer, more efficient and lower cost storage of most common hand held portable hair dryers, said receptacle comprising: a one piece molded housing having a flat back side for mating with and installation onto a wall, said flat back side being part of the remaining housing, said housing having an attached enclosure side which adjoins to the flat back side, said enclosure side emanating from said flat back side into a flat sided surface said flat sided surface of said enclosure side does arc and curve to a front flat sided surface of said enclosure surface from both sides of said flat back side, thereby forming a less than square like enclosure surface having rounded and arc like corners at the outermost sides of said enclosure side relative to said flat back side, and thus both emanating flat side surfaces emanating outward from said flat back side and both said flat sides of said enclosure side adjoining the said front side of said enclosure side in a curved and arc like fashion at both front facing corners of said enclosure side of said housing, said attached enclosure side emanating from said flat back side from a point below the upper most and widest part of said flat back side and said enclosure side emanating above the lower most and narrow most part of said flat back side so that a portion of said flat back side is exposed above and below said enclosure side to enable installer access to holes provided in said flat back side and said holes located within said exposed upper and lower areas of said flat back side for installation, said enclosure side at both upper and lower adjoinments to said flat back side on both sides of said flat back side having arc like adjoinment to strengthen said adjoinments at all points of said adjoinments and said enclosure side having multiple tapered slots or openings within said enclosure side opening and emanating from the upper most edge of said enclosure side whereby said slots are wider in opening at the upper most point of said enclosure side and said slots are tapered variably downward to narrower openings at the lower most point of said slots within said enclosure side of said housing, said slots to provide multiple positions for the insertion of most common hair dryer handles of said hair dryers and said housing comprised of the combined said flat back side and said enclosure side to accommodate the greater part or bulk of a said hair dryer, said hair dryer to be inserted within said housing being tapered in a reducing and variable capacity being larger in capacity at and within the upper most and widest part of said housing, said upper end of said housing having the larger capacity for the blower and heater portion of said hair dryer and said housing then variably reducing in size and capacity to the lower most and narrow portion of said housing to accommodate the insertion of the blower tube portion of most said hair dryers, said housing also having at the front of said enclosure side, an adjoining hook configuration being adjoined to the outer most and lower most side previously described as the front enclosure side being the furthest distance from and parallel to said flat back side and said adjoining hook being almost as wide as the distance in width of said front side of said enclosure side of said housing of said receptacle, and that the variability of sizing and taper of said receptacle within said housing and within said slots, does facilitate variable accommodation to varying sizes of many common portable hand held hair dryers within a one piece molded construction not capable of disassembly and thus providing a greater degree of safety as well as practicality.

2. A universal, multi-positional storage receptacle for the storage of most common hand held portable hair dryers as described in claim 1, said receptacle by nature of its design, having multiple hair dryer handle insertion slots of varying size and taper to accommodate multiple storage positions of said hair dryers and thus the variability of installation choice of wall being left, right or forward of and relative to said user, and further providing said user multiple options of storing said hair dryer in the least obstructive manner relative to said user's choice of hair dryer handle position, thus enabling user to store said hair dryer in the safest, least obstructive, most efficient and space saving fashion.

* * * * *